US011617907B2

(12) United States Patent
Bjorkman et al.

(10) Patent No.: US 11,617,907 B2
(45) Date of Patent: Apr. 4, 2023

(54) FIRE SUPPRESSION NOZZLE

(71) Applicant: Tyco Fire Products LP, Lansdale, PA (US)

(72) Inventors: Donald M. Bjorkman, Menominee, MI (US); Daniel I. Meyer, Marinette, WI (US)

(73) Assignee: Tyco Fire Products LP, Lansdale, PA (US)

( * ) Notice: Subject to any disclaimer, the term of this patent is extended or adjusted under 35 U.S.C. 154(b) by 273 days.

(21) Appl. No.: 16/834,878

(22) Filed: Mar. 30, 2020

(65) Prior Publication Data

US 2020/0316418 A1 Oct. 8, 2020

Related U.S. Application Data

(60) Provisional application No. 62/829,966, filed on Apr. 5, 2019.

(51) Int. Cl.
*A62C 13/76* (2006.01)
*B05B 1/34* (2006.01)

(52) U.S. Cl.
CPC ..... *A62C 13/76* (2013.01); *B05B 1/34* (2013.01)

(58) Field of Classification Search
CPC ..... A62C 13/76; A62C 13/003; B05B 1/34; B05B 1/28; B05B 1/265; B05B 1/267
USPC ..... 169/70, 74, 77, 85, 89; 239/499, 500, 239/504
See application file for complete search history.

(56) References Cited

U.S. PATENT DOCUMENTS

| | | | | |
|---|---|---|---|---|
| 2,967,570 | A * | 1/1961 | Nurkiewicz | A62C 31/005 169/70 |
| 3,447,610 | A * | 6/1969 | Guise | A62C 13/006 169/77 |
| 6,065,547 | A * | 5/2000 | Ellis, Jr. | A62C 13/62 239/499 |
| 2013/0186655 | A1* | 7/2013 | Mauney | A62C 3/006 169/74 |

FOREIGN PATENT DOCUMENTS

| | | | |
|---|---|---|---|
| CN | 105561507 | A | 5/2016 |
| JP | 4623540 | B2 | 2/2011 |
| JP | 6087633 | B2 | 3/2017 |
| JP | 2018-089271 | A | 6/2018 |

* cited by examiner

*Primary Examiner* — Steven J Ganey
(74) *Attorney, Agent, or Firm* — Foley & Lardner LLP

(57) ABSTRACT

A fire suppression apparatus is configured to spray a fire suppressant agent and includes a reservoir and a nozzle. The nozzle is fluidly coupled to the reservoir and includes an inlet aperture, an outlet aperture, a passageway, and a diverter. The passageway extends between the inlet aperture and the outlet aperture. The diverter is disposed within the passageway and includes multiple diverter passageways configured to receive the fire suppressant agent from an inner volume of the diverter and direct the fire suppressant agent towards an inner sidewall of the passageway.

20 Claims, 6 Drawing Sheets

FIRE SUPPRESSION NOZZLE

CROSS-REFERENCE TO RELATED PATENT APPLICATION

This application claims the benefit of and priority to U.S. Provisional Patent Application No. 62/829,966, filed Apr. 5, 2019, the entire disclosure of which is incorporated by reference herein.

BACKGROUND

Fire suppression systems include tanks containing a fire suppressant/suppression agent. The fire suppressant agent can be provided to an area (e.g., an interior volume of a duct) via a nozzle. In some applications, a valve actuates into an open/activated configuration to fluidly provide the fire suppressant agent to the nozzle.

SUMMARY

One implementation of the present disclosure is a fire suppression apparatus, according to an exemplary embodiment. The fire suppression apparatus is configured to spray a fire suppressant agent and includes a reservoir and a nozzle. The nozzle is fluidly coupled to the reservoir and includes an inlet aperture, an outlet aperture, a passageway, and a diverter. The passageway extends between the inlet aperture and the outlet aperture. The diverter is disposed within the passageway and includes multiple diverter passageways configured to receive the fire suppressant agent from an inner volume of the diverter and direct the fire suppressant agent towards an inner sidewall of the passageway.

In some embodiments, an inner diameter of the inner sidewall varies along a longitudinal length of the passageway.

In some embodiments, the inner diameter of the inner sidewall increases linearly or non-linearly along the longitudinal length of the passageway.

In some embodiments, the inner diameter of the inner sidewall decreases linearly or non-linearly along the longitudinal length of the passageway.

In some embodiments, the fire suppression apparatus further includes a rate controlling orifice positioned along the passageway. The rate controlling orifice is a most restrictive portion of the nozzle along the passageway and is sized to determine an amount of time required to fully discharge the fire suppressant agent from the reservoir.

In some embodiments, the multiple diverter passageways are angled and the diverter is configured to affect a distance that the fire suppressant agent is discharged after the fire suppressant agent exits the nozzle and a spread of the fire suppressant agent after the fire suppressant agent exits the nozzle.

In some embodiments, an interior shape of the inner sidewall is configured to affect at least one of the spread of the fire suppressant agent after the fire suppressant agent exits the nozzle or the distance of the fire suppressant agent after the fire suppressant agent exits the nozzle.

In some embodiments, the fire suppressant agent is any of a dry fire suppressant agent, a wet fire suppressant agent, and a clean fire suppressant agent.

In some embodiments, the fire suppression apparatus is any of a handheld fire suppression apparatus, a wheel fire suppression apparatus, or a fire suppression apparatus system for an area.

In some embodiments, the diverter includes a frustoconical portion and a generally cylindrical portion. In some embodiments, the frustoconical portion is at a downstream end of the diverter, and the generally cylindrical portion it at an upstream end of the diverter.

In some embodiments, the diverter includes a converging inlet that fluidly couples with the plurality of diverter passageways.

Another implementation of the present disclosure is a nozzle for a fire suppression apparatus, according to an exemplary embodiment. The nozzle includes a body and a diverter. The body includes an inner volume, an inlet aperture, and an outlet aperture. The inlet aperture, the outlet aperture, and the inner volume define a flow path between an inlet end and an outlet end of the nozzle. The diverter is positioned along the flow path and includes a converging inlet, and multiple angled passageways. The diverter is configured to receive fire suppressant agent that flows along the fluid flow path through the converging inlet and discharge the fire suppressant agent through the multiple angled passageways. In some embodiments, the diverter is configured to sealingly engage an inner surface of the body.

In some embodiments, the nozzle further includes an orifice positioned along the flow path. The orifice is sized to determine an amount of time required to fully discharge a stored quantity of fire suppressant agent of the fire suppression apparatus.

In some embodiments, the diverter is configured to receive the fire suppressant agent through the converging inlet from a diverging passageway of the inner volume.

In some embodiments, the diverter discharges the fire suppressant agent through the multiple angled passageways towards an interior surface of a barrel portion of the inner volume. The interior surface of the barrel portion of the inner volume may change in shape along the fluid flow path to affect a discharge distance or a spread of fire suppressant agent after the fire suppressant agent exits the nozzle through the outlet aperture. The barrel portion of the inner volume fluidly couples with the outlet aperture of the body.

In some embodiments, the multiple angled passageways are angled to achieve a particular discharge distance or a particular spread of fire suppressant agent after the fire suppressant agent exits the nozzle through the outlet aperture.

In some embodiments, the fluid flow path is defined from the inlet aperture, along a portion of the inner volume of the body that is upstream from the diverter, through the converging inlet and the multiple angled passageways of the diverter, along the barrel portion of the inner volume, and through the outlet aperture of the body.

Another implementation of the present disclosure is a fire suppression apparatus, according to an exemplary embodiment. The fire suppression apparatus includes a container and a nozzle. The container is configured to store a fire suppressant agent. The nozzle is fluidly coupled with the container and is configured to receive the fire suppressant agent from the container and discharge the fire suppressant agent. The nozzle includes a passageway, a rate controlling orifice, a diverter, and a barrel. The passageway is fluidly coupled with the container. The rate controlling orifice is positioned along the passageway. The diverter is positioned within the passageway downstream from the rate controlling orifice. The diverter includes an inner volume and multiple angled passageways. The inner volume is fluidly coupled with the passageway of the nozzle and is fluidly coupled with the multiple angled passageways. The barrel is configured to receive fire suppressant agent that exits the multiple angled passageways and direct the fire suppressant agent through an outlet of the nozzle.

In some embodiments, the angled passageways are angled so that the fire suppressant agent that flows through the diverter is directed outwards towards an interior surface of the barrel to achieve a specific discharge distance or spread of the fire suppressant agent after the fire suppressant agent exits the nozzle through the outlet.

In some embodiments, a volumetric flow rate permitted by the rate controlling orifice is greater than or equal to a volumetric flow rate permitted by the diverter.

The invention is capable of other embodiments and of being carried out in various ways. Alternative exemplary embodiments relate to other features and combinations of features as may be recited herein.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present disclosure is not limited to the details or methodology set forth in the description or illustrated in the figures. It should also be understood that the terminology used herein is for the purpose of description only and should not be regarded as limiting.

Overview

Various embodiments disclosed herein relate to a fire suppression apparatus with more points of controllability. The additional points of controllability may provide desired combinations of discharge time, discharge length, and spread of the fire suppressant agent. Referring generally to the FIGURES, a fire suppression apparatus is shown, according to an exemplary embodiment. The fire suppression/suppressant apparatus includes a tank containing a fire suppression/suppressant agent and a nozzle fluidly coupled to the tank. The nozzle is configured to receive the fire suppressant agent from the tank and spray the fire suppressant agent at a discharge length and a spread. The nozzle includes a rate controlling orifice, a diverter, and a barrel. The diverter includes one or more diverter holes which extend radially outwards from a centerline of the nozzle at an angle. The rate controlling orifice is the most restrictive portion which fire suppressant agent encounters and can be adjusted to achieve a desired discharge time. The discharge time is the amount of time required to fully discharge the fire suppressant agent from the tank. The number, size, angle, shape, and orientation of the diverter holes, as well as the geometry of the barrel can be adjusted to achieve a desired discharge length and a desired spread of the fire suppressant agent after it exits the nozzle. Other fire suppression apparatuses provide only one or two points of controllability, and some combinations of desired discharge time, discharge length, and spread of the fire suppressant agent cannot be achieved. Advantageously, the nozzle provides three points of controllability: the rate controlling orifice, the diverter, and the barrel. The geometry and configuration of the rate controlling orifice, the diverter, and the barrel can be adjusted to achieve a combination of desired values of the discharge time, the discharge length, and the spread (e.g., pattern) of the fire suppressant agent which other fire suppression apparatuses cannot achieve.

Fire Suppression Tank and Nozzle

Figure 1:
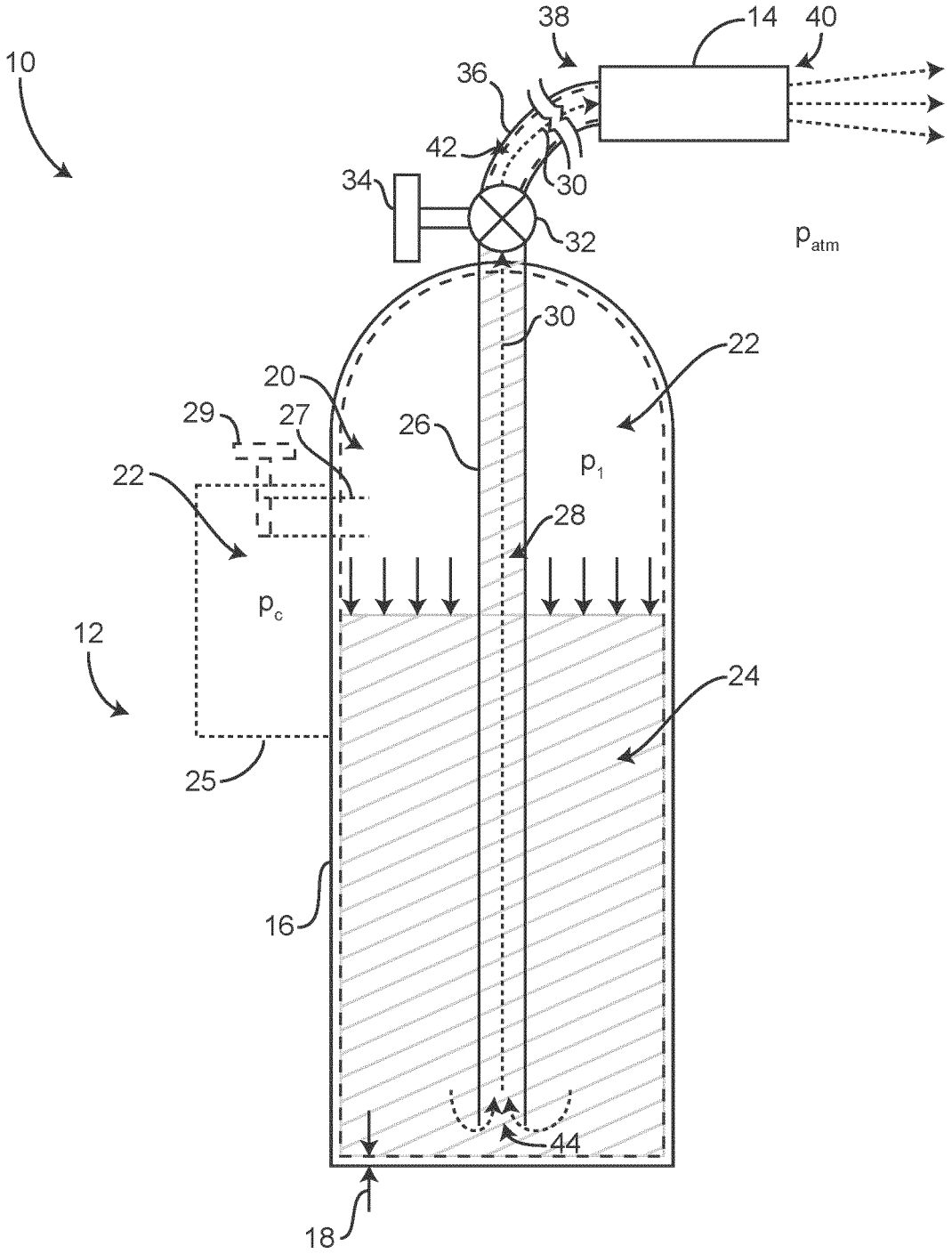
FIG. 1 is diagram of a fire suppression apparatus having a tank containing a fire suppressant agent fluidly coupled with a nozzle, according to an exemplary embodiment.

Referring now to FIG. 1, a fire suppression apparatus 10 is shown, according to an exemplary embodiment. Fire suppression apparatus 10 is configured to selectably provide a fire suppressant agent to an area for fire suppression. The fire suppressant agent can be any of a wet fire suppressant agent, a dry fire suppressant agent, a clean fire suppressant agent, etc. Fire suppression apparatus 10 may be a portable (e.g., a handheld, wheeled, etc.) fire suppression apparatus or may be a permanent fire suppression apparatus for a building space, a duct, a vent, a cooking application, an automotive application, etc. Fire suppression apparatus 10 includes a tank, reservoir, canister, chamber, fire suppressant containing device, etc., shown as container 12. Container 12 is configured to contain an amount of fire suppressant agent 24 (e.g., a mass $m_{FSA}$, a volume $V_{FSA}$, etc.), within inner volume 20. Inner volume 20 may be defined by sidewalls 16 of container 12. Fire suppressant agent 24 may be an incompressible material, or may be compressible (e.g., have variable density $\rho_{FSA}$). Container 12 includes a propellant gas 22 (e.g., an ideal gas, a non-ideal gas, nitrogen, hydrogen, etc.). If propellant gas 22 is an ideal gas, propellant gas 22 follows the ideal gas equation:

$$p_1V_1=m_1R_1T_1$$

where $p_1$ is a pressure of propellant gas 22 within inner volume 20, $V_1$ is an amount of volume which propellant gas 22 takes up within inner volume 20, $m_1$ is a mass of propellant gas 22 within inner volume 20, $R_1$ is the ideal gas constant of propellant gas 22, and $T_1$ is the temperature of propellant gas 22.

The density of propellant gas 22, $\rho_1$ is less than the density $\rho_{FSA}$ of fire suppressant agent 24. Since $\rho_1<\rho_{FSA}$, fire suppressant agent 24 is at a bottom portion of container 12, with propellant gas 22 above fire suppressant agent 24. Propellant gas 22 exerts pressure $p_1$ at a top surface of fire suppressant agent 24. In an exemplary embodiment, propellant gas 22 and fire suppressant agent 24 are in equilibrium before fire suppression apparatus 10 is activated. For example, propellant gas 22 and fire suppressant agent 24 may be in static equilibrium.

As shown in FIG. 1, fire suppression apparatus 10 includes a tube, pipe, flow passage, etc., shown as supply tube 26, according to an exemplary embodiment. Supply tube 26 includes inner volume 28 configured to fluidly couple inner volume 20 of container 12 with nozzle 14. Supply tube 26 extends at least partially into inner volume 20 of container 12. An end of supply tube 26 extends into fire suppressant agent 24 contained within inner volume 20. The end of supply tube 26 includes aperture 44 configured to receive fire suppressant agent 24 therethrough. Due to the pressure $p_1$ exerted on fire suppressant agent 24 by propellant gas 22, fire suppressant agent 24 may substantially fill an entire height of supply tube 26. For example, as shown in FIG. 1, fire suppressant agent 24 fills inner volume 28 of supply tube 26 due to $p_1$ exerted by propellant gas 22.

Fire suppression apparatus 10 includes a valve 32 fluidly coupled with supply tube 26. Valve 32 is configured to actuate between an open and a closed configuration. Valve 32 is fluidly coupled with supply tube 26 and a hose, pipe, tube, conduit, etc., shown as hose 36. Hose 36 includes inner volume 42. Hose 36 is fluidly coupled to nozzle 14 and is configured to fluidly couple valve 32 with nozzle 14. Hose 36, valve 32, and supply tube 26 define fluid flow path 30. Fluid flow path 30 extends from within inner volume 20 of container 12, through inner volume 28 of supply tube 26, through valve 32 (e.g., through an inner volume of valve 32), and through inner volume 42 of hose 36 to fluidly couple inner volume 20 of container 12 with nozzle 14. Valve 32 is positioned along fluid flow path 30 and is configured to either restrict or facilitate the flow of fire suppressant agent 24 along fluid flow path 30. When valve 32 is in the closed configuration, fire suppressant agent 24 is restricted from passing through valve 32. When valve 32 is in the open configuration, fire suppressant agent 24 is allowed to flow along fluid flow path 30 to nozzle 14, through valve 32. Valve 32 may be transitioned between the open configuration and the closed configuration by control of actuator 34. Actuator 34 may be a mechanical (e.g., a user operated actuator) actuator, such as a knob, a handle, a lever, etc. In other embodiments, actuator 34 is an electric actuator (e.g., a solenoid, an electronic actuator, a motor, etc.) configured to cause valve 32 to transition between the open configuration and the closed configuration in response to a user input (e.g., in response to a user pressing a button, flipping a switch, etc.). FIG. 1 shows valve 32 in the closed configuration, thereby restricting the flow of fluid. When valve 32 is transitioned into the open configuration, fire suppressant agent 24 may flow along fluid flow path 30, through valve 32, and through an inlet aperture 104 (see FIG. 2) of inlet end 38 of nozzle 14. Fire suppressant agent 24 may flow through nozzle 14 and exit outlet end 40 of nozzle 14 via outlet aperture 105 (see FIG. 2). Nozzle 14 may be configured to diffuse, disperse, spread, spray, etc., fire suppressant agent 24.

Figure 2:
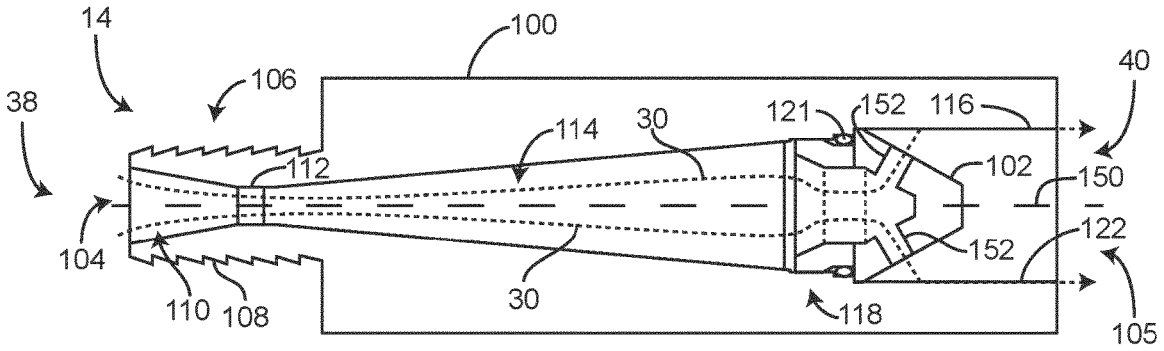
FIG. 2 is a side sectional view of the nozzle of FIG. 1, including a body and a diverter, according to an exemplary embodiment.

When valve 32 is transitioned into the open configuration, fire suppressant agent 24 may flow along fluid flow path 30 due to the pressure $p_1$ exerted on it by propellant gas 22. Fire suppressant agent 24 may flow along fluid flow path 30 at a volumetric flow rate $\dot{V}_{FSA}$ or at a mass flow rate $\dot{m}_{FSA}$. Fire suppressant agent 24 may flow along fluid flow path 30 at a constant volumetric/mass flow rate, or may flow along fluid flow path 30 at a variable volumetric/mass flow rate. The value of the volumetric/mass flow rate of fire suppressant agent 24 along fluid flow path 30 may be proportional to the pressure $p_1$ exerted by propellant gas 22 and/or a restricting orifice (i.e., orifice 112 as shown in FIG. 2) along fluid flow path 30. Additionally, fire suppressant agent 24 may flow along fluid flow path 30 downstream of the restricting orifice at velocity $v_{FSA}$. The volumetric/mass flow rate of fire suppressant agent 24 may determine a discharge time $\Delta t_{discharge}$. The discharge time $\Delta t_{discharge}$ is defined as an amount of time which it takes for all of fire suppressant agent 24 to be discharged from container 12 along fluid flow path 30. For example, the discharge time may be:

$$\Delta t = \frac{V_{FSA}}{\dot{V}_{FSA}},$$

assuming a constant value (e.g., an average value) of volumetric flow rate $\dot{V}_{FSA}$. As fire suppressant agent 24 is discharged from inner volume 20, the amount of fire suppressant agent 24 within inner volume 20 decreases, and the volume which propellant gas 22 takes up increases. As the volume which propellant gas 22 takes up increases, the pressure $p_1$ which propellant gas 22 exerts on fire suppressant agent 24 may decrease, due to the inverse proportional relationship shown below:

$$p_1 \propto \frac{1}{V_1}$$

The volumetric flow rate of fire suppressant agent 24, $\dot{V}_{FSA}$, may decrease as $p_1$ decreases. The volumetric flow rate of fire suppressant agent 24 is related to at least one of the pressure exerted by propellant gas 22 and the discharge coefficient $C_d$ of the restricting orifice as shown:

$$\dot{V}_{FSA}=f(C_d)$$

or:

$$\dot{V}_{FSA}(t)=f(p_1(t))$$

or:

$$\dot{V}_{FSA}(t)=f(C_d,p_1(t))$$

Depending on initial and final pressures $p_{1,i}$ and $p_{1,f}$ (e.g., pressure of propellant gas 22 after all or substantially all of fire suppressant agent 24 has been discharged from inner volume 20) of propellant gas 22, the discharge coefficient $C_d$ alone may determine the volumetric flow rate $\dot{V}_{FSA}$. For example, if propellant gas 22 is pressurized such that the final pressure $p_{1,f}$ eclipses the restrictions due to the value of the discharge coefficient $C_d$, the change in pressure of propellant gas 22 may be neglected and the discharge coefficient $C_d$ may determine the volumetric flow rate of fire suppressant agent 24, with increasing $C_d$ corresponding to increasing $\dot{V}_{FSA}$.

The discharge time $\Delta t_{discharge}$ is related to the volumetric flow rate $\dot{V}_{FSA}$ of fire suppressant agent 24, as shown:

$$\Delta t_{discharge}=f(\dot{V}_{FSA})$$

with increasing $\dot{V}_{FSA}$ corresponding to decreasing $\Delta t_{discharge}$ and vice versa.

Increasing the volumetric flow rate $\dot{V}_{FSA}$ of fire suppressant agent 24 decreases the discharge time $\Delta t_{discharge}$. Since $\dot{V}_{FSA}=f(C_d)$ such that increasing $C_d$ increases $\dot{V}_{FSA}$, increasing the discharge coefficient $C_d$ also decreases the discharge time $\Delta t_{discharge}$. In this way, the restricting orifice can be adjusted to improve the discharge time $\Delta t_{discharge}$ (e.g., increasing or decreasing the discharge time $\Delta t_{discharge}$ as desired) and/or to improve the volumetric flow rate $\dot{V}_{FSA}$ of fire suppressant agent 24.

Fire suppression apparatus 10 may be a stored pressure fire suppression apparatus as shown in FIG. 1, or may be a cartridge operated fire suppression apparatus. For example, fire suppression apparatus 10 may include a tank, reservoir, container, etc., shown as cartridge 25. Cartridge 25 can be configured to contain propellant gas 22 at an inner volume therewithin and fluidly couple with inner volume 20 of container 12 via a conduit, pipe, tubular member, etc., shown as conduit 27. Cartridge 25 can be actuated via actuator 29 such that propellant gas 22 exerts pressure on fire suppressant agent 24 and drive fire suppressant agent 24 through supply tube 26. Actuator 29 can include a plunger configured to transition between an open configuration to fluidly couple the inner volume of cartridge 25 to inner volume 20 of container 12, and a closed position such that the inner volume of cartridge 25 is not fluidly coupled with inner volume 20 of container 12. Propellant gas 22 can be pressurized at pressure $p_c$ within the inner volume of cartridge 25. In some embodiments, pressure $p_c$ is equal to pressure $p_1$. Cartridge 25 may include a regulator (e.g., a pressure regulator) fluidly coupled in line with conduit 27 to facilitate a constant volumetric flow rate of fire suppressant agent 24 provided to nozzle 14. In some embodiments, if fire suppression apparatus 10 is a stored pressure fire suppression apparatus, the volumetric flow rate $\dot{V}_{FSA}$ of fire suppressant agent 24 provided to nozzle 14 decays over time. In some embodiments, if fire suppression apparatus 10 is a cartridge operated fire suppression apparatus, the volumetric flow rate $\dot{V}_{FSA}$ of fire suppressant agent 24 is substantially constant over the entirety of the discharge time $\Delta t_{discharge}$.

Discharge Nozzle

Overview

Referring now to FIG. 2, nozzle 14 is shown in greater detail, according to an exemplary embodiment. Nozzle 14 is shown to include a body 100, and an inlet portion 106. Nozzle 14 includes inlet end 38 and outlet end 40. Inlet end 38 includes inlet aperture 104 configured to facilitate the flow of fluid into an inner volume of nozzle 14. Outlet end 40 includes outlet aperture 105 configured to facilitate the egress of fluid from the inner volume of nozzle 14. Nozzle 14 includes an inner volume (e.g., one or more inner volumes, one or more fluid passageways, one or more chambers, one or more diverging sections, one or more converging sections, etc.) extending between inlet aperture 104 and outlet aperture 105 configured to fluidly connect inlet aperture 104 and outlet aperture 105. Fluid (e.g., fire suppressant agent 24) may flow into nozzle 14 at inlet end 38 via inlet aperture 104 and exit nozzle 14 at outlet end 40 via outlet aperture 105, according to an exemplary embodiment. The inner volume of nozzle 14 between inlet aperture 104 and outlet aperture 105 defines one or more fluid flow paths 30 therebetween.

Nozzle 14 includes central axis 150, according to an exemplary embodiment. Central axis 150 extends along an entire length of nozzle 14 through a center of nozzle 14. For example, central axis 150 may extend normal to and through a center of a cross-sectional area of nozzle 14. Central axis 150 defines a longitudinal direction of nozzle 14. For example, central axis 150 may pass normal to and through a center point of inlet aperture 104 at a first longitudinal position (e.g., inlet end 38), and a center point of outlet aperture 105 at a second longitudinal position (e.g., outlet end 40).

Inlet portion 106 is configured to fluidly couple nozzle 14 with hose 36, according to an exemplary embodiment. Inlet portion 106 may include a frustoconical inner volume 110, an orifice 112, and at least a portion of frustoconical inner volume 114. Frustoconical inner volume 110, orifice 112, and frustoconical inner volume 114 may define a fluid flow path therewithin. The fluid flow path defined by frustoconical inner volume 110, orifice 112, and frustoconical inner volume 114 can be fluidly coupled with inlet aperture 104 to facilitate the entry and flow of fluid therewithin. Frustoconical inner volume 114 may be a diverging inner volume, a diverging passage, etc., or an inner volume that increase along the fluid flow path.

Inlet portion 106 includes one or more barbs, interfacing members, ribs, etc., shown as barbs 108 along an outer periphery (e.g., an outer diameter, an outer surface, etc.) of inlet portion 106. Barbs 108 are configured to interface with an inner periphery (e.g., an inner surface, an inner face, an inner diameter, etc.) of hose 36. Barbs 108 facilitate a sealed interface between hose 36 and inlet portion 106. In an exemplary embodiment, inlet portion 106 is configured to protrude a distance into an inner volume of hose 36 to fluidly couple hose 36 and inlet portion 106. In some embodiments, inlet portion 106 includes threads, pipe threads, etc., or any other joint type along the outer periphery (e.g., the outer diameter, the outer surface, etc.) of inlet portion 106. For example, inlet portion 106 can include hose-type threads configured to threadingly and sealingly interface with an interfacing portion of a wheeled unit. In some embodiments, nozzle 14 is used in a piped system and is configured to sealingly (e.g., via threads, or any other joint) and fluidly couple with a pipe (e.g., a conduit, a hose, a tubular member, etc.) of the piped system.

In an exemplary embodiment, orifice 112 is a rate controlling orifice. For example, orifice 112 may have discharge coefficient $C_d$ and resistance coefficient K where $$K=\frac{1}{C_d^2}.$$

Orifice 112 may be the smallest orifice (e.g., the most restrictive portion) along fluid flow path 30, therefore the discharge coefficient $C_d$ and the resistance coefficient K or orifice 112 control the volumetric flow rate of fire suppressant agent 24 along fluid flow path 30 and the discharge time $\Delta t_{discharge}$ of fire suppressant agent 24. The discharge coefficient $C_d$ and/or the resistance coefficient K of orifice 112 may be adjusted (e.g., by changing the geometry, size, etc., of orifice 112) to achieve a desired volumetric flow rate $\dot{V}_{FSA}$ of fire suppressant agent 24 and/or to achieve a desired discharge time $\Delta t_{discharge}$ of fire suppressant agent 24.

Referring still to FIG. 2, body 100 is shown to include diverter portion 118, and a bore, hole, aperture, cylindrical inner volume, etc., shown as barrel 116. Barrel 116 and diverter portion 118 define an inner volume therewithin fluidly coupled to frustoconical inner volume 114. The inner volume of barrel 116 and diverter portion 118 fluidly couple frustoconical inner volume 114 with outlet aperture 105.

Figure 14:
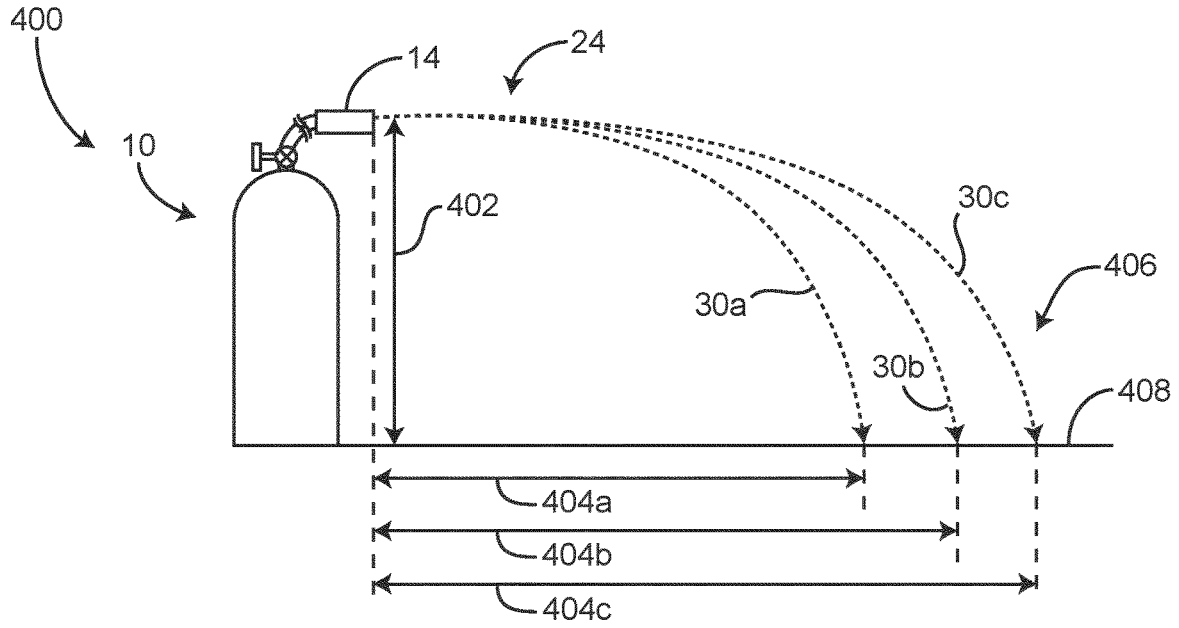
FIG. 14 is a diagram showing the effect on discharge length of adjustments to the angulation of the diverter holes and/or the geometry of the barrel of the nozzle of FIG. 2, according to an exemplary embodiment.
Figure 15:
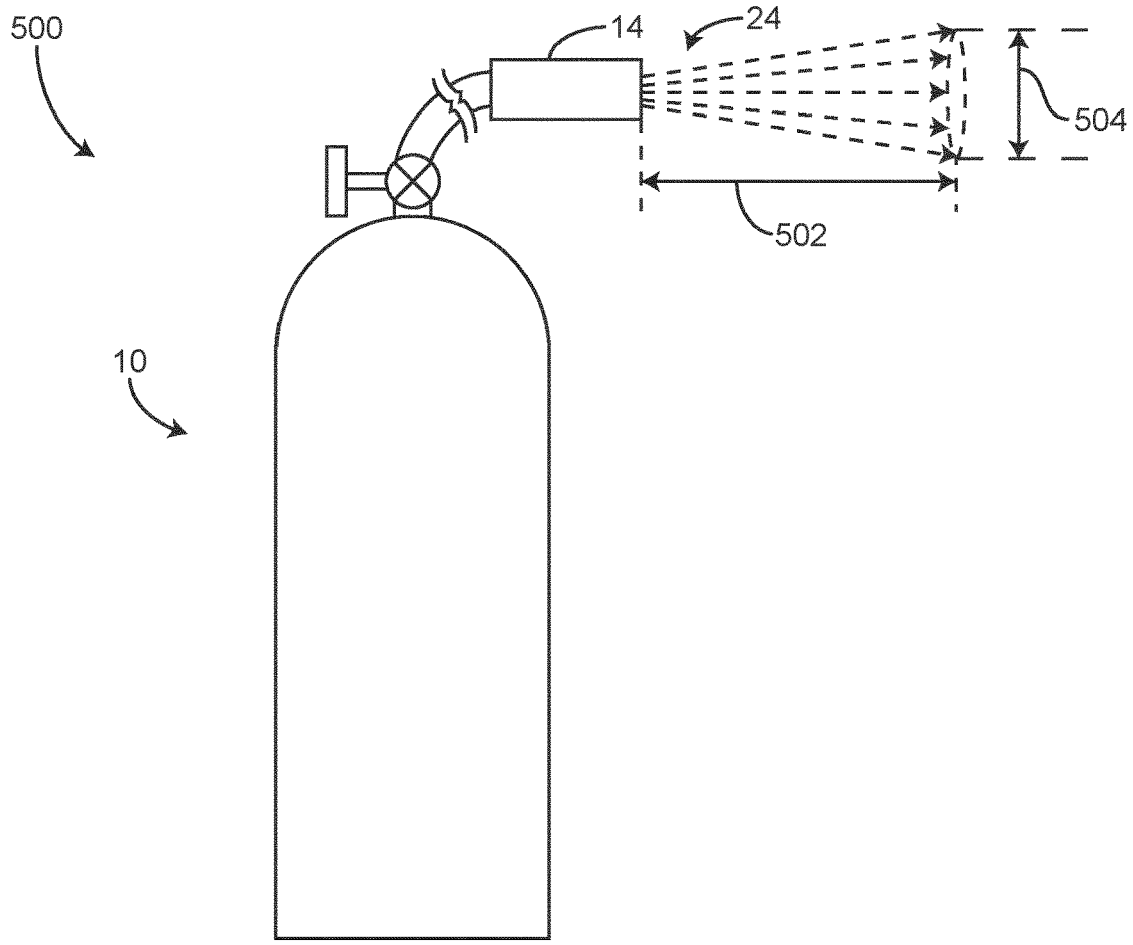
FIG. 15 is a diagram showing spread diameter of the nozzle of FIG. 2, according to an exemplary embodiment.

Nozzle 14 includes diverter 102 configured to direct, guide, spread, etc., fluid (e.g., fire suppressant agent 24) flowing along fluid flow path 30. Diverter 102 is configured to divert (e.g., direct) fire suppressant agent 24 at least partially radially outwards towards an inner periphery, an inner surface, an inner face, an inner wall, etc., of barrel 116, shown as inner surface 122. Diverter 102 may include one or more channels, passageways, orifices, holes, bores, etc., shown as diverter holes 152. Diverter holes 152 are angled relative to central axis 150 and are configured to direct the flow of fluid along fluid flow path 30 outwards towards inner surface 122 of barrel 116. The size, number, and angle of diverter holes 152 can be adjusted to achieve a desired spread/shape (e.g., discharge diameter 504 as shown in FIG. 15), and discharge length (e.g., discharge length 404 as shown in FIG. 14) of fluid (e.g., fire suppressant agent 24) exiting outlet aperture 105. Diverter 102 includes one or more inner passageways therewithin such that fluid can flow through the one or more inner passageways of diverter 102. Diverter 102 may fluidly couple frustoconical inner volume 114 with inner volume 120 (see FIG. 3) of barrel 116. Diverter 102 defines a fluid passageway (e.g., fluid flow path 30) within the one or more inner passageways (e.g., diverter holes 152).

Referring still to FIG. 2, diverter 102 is shown interfacing with an inner periphery, inner surface, or inner diameter, inner face, etc., of diverter portion 118, according to an exemplary embodiment. Diverter 102 can be configured to threadingly interface with the inner surface of diverter portion 118. In an exemplary embodiment, a seal (e.g., an O-ring, a seal ring, etc.), shown as O-ring 121 is deposed between an inner periphery of diverter portion 118 and an outer periphery (e.g., an outer surface, an outer face, etc.) of diverter 102. Flow of fluid between the outer periphery of diverter 102 and the inner periphery of diverter portion 118 is restricted (e.g., fluid cannot flow therebetween) due to the interface between the outer periphery of diverter 102 and the inner periphery of diverter portion 118 (e.g., a threaded interface) and O-ring 121 disposed therebetween. Advantageously, this ensures that the fluid (e.g., fire suppressant agent 24) flows through the inner volume, inner channels, inner passageways, etc., of diverter 102.

Nozzle Body

Figure 3:
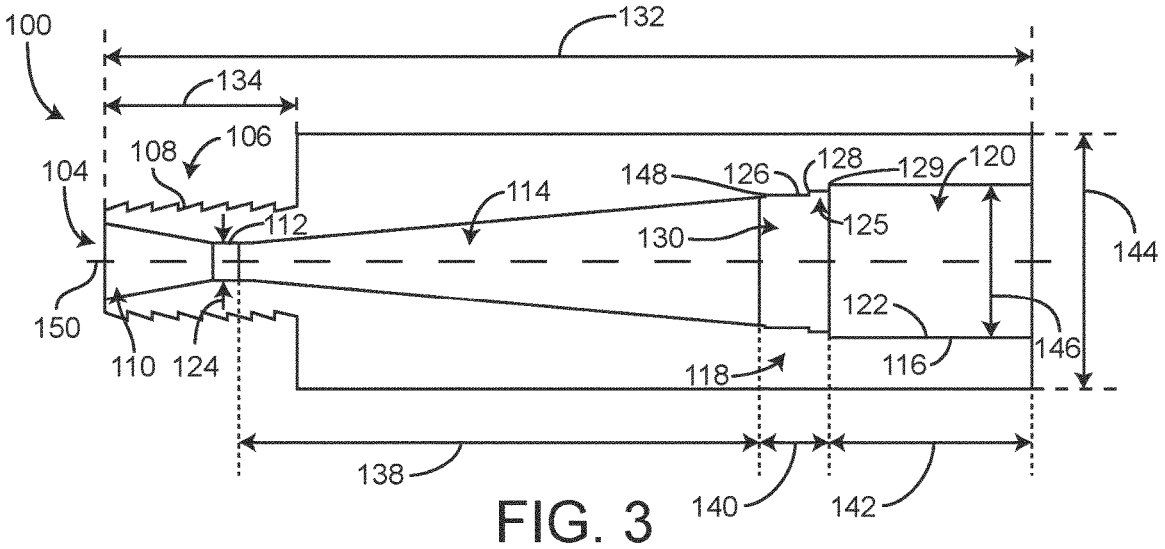
FIG. 3 is a side sectional view of the body of the nozzle of FIG. 2, according to an exemplary embodiment.

Referring now to FIG. 3, body 100 is shown in greater detail, according to an exemplary embodiment. Body 100 has an overall longitudinal length 132. Length 132 is measured from inlet aperture 104 to outlet aperture 105. Length 132 may be adjusted to adjust an amount of frictional head loss of fire suppressant agent 24 which flows therethrough body 100.

Body 100 includes inlet portion 106. Inlet portion 106 is shown having longitudinal length 134. Frustoconical inner volume 114 increases in diameter along the entirety of its length, shown as longitudinal length 138. Frustoconical inner volume 114 may extend within inlet portion 106. Inlet portion 106 may include barbs 108 along substantially the entire length 134. In an exemplary embodiment, the entire length 134 of inlet portion 106 is configured to be inserted into an inner volume of hose 36. Frustoconical inner volume 110 is shown having a converging shape, with a diameter of frustoconical inner volume 110 decreasing along central axis 150. Frustoconical inner volume 110 may decrease in diameter (e.g., converge) until frustoconical inner volume 110 is substantially equal to diameter 124 (i.e., $d_{orifice}$) of orifice 112. Orifice 112 has inner diameter 124. In an exemplary embodiment, inner diameter 124 is a minimum diameter of nozzle 14, supply tube 26, valve 32, hose 36, etc., such that orifice 112 is the most restrictive portion which fire suppressant agent 24 encounters along fluid flow path 30. A cross-sectional area. $A_{orifice}$, of orifice 112 can be determined based on $$d_{orifice} \text{ as } A_{orifice} = \pi\left(\frac{d_{orifice}}{2}\right)^2.$$

$A_{orifice}$ may be a minimum cross sectional area which fire suppressant agent 24 flows through as it is discharged from inner volume 20 of container 16. In this way, orifice 112 is the most restrictive portion which fire suppressant agent 24 encounters along fluid flow path 30. The discharge coefficient $C_d$ and/or the resistance coefficient K of orifice 112 can be determined based on $d_{orifice}$ and/or $A_{orifice}$ (i.e., $C_d=f(A_{orifice})$ or $C_d=f(d_{orifice})$ if orifice 112 is circular). Orifice 112 may have a non-negligible longitudinal length. In other embodiments, orifice 112 has a negligible longitudinal length along central axis 150.

Referring still to FIG. 3, body 100 includes frustoconical inner volume 114. Frustoconical inner volume 114 may increase in diameter along substantially an entire longitudinal length 138 of frustoconical inner volume 114. In some embodiments, the diameter of frustoconical inner volume 114 increases linearly along length 138. In some embodiments, the diameter of frustoconical inner volume 114 increases non-linearly along length 138.

Referring still to FIG. 3, body 100 includes diverter portion 118. Diverter portion 118 is configured to receive diverter 102 therewithin to secure diverter 102 to body 100, prevent the flow of fluid along any of the outer surfaces, peripheries, edges, faces, etc., of diverter 102, and force fluid flowing through nozzle 14 to enter and flow through one or more passageways, inner volumes, etc., of diverter 102. Diverter portion 118 includes an inner volume 130 configured to receive at least a portion of diverter 102 therewithin. Diverter portion 118 includes a cylindrical inner periphery 126 (e.g., an inner surface, an inner face, an inner edge, an inner diameter, etc.) configured to interface with the outer periphery of diverter 102. In some embodiments, inner periphery 126 includes threads configured to threadingly and sealingly interface with threads on the outer periphery of diverter 102. In other embodiments, inner periphery 126 is configured to press fit, interference fit, slip fit, etc., with the outer periphery of diverter 102. Diverter portion 118 may include a groove, channel, depression, notch, etc., shown as groove 125. Groove 125 is configured to receive O-ring 121 therewithin. Groove 125 may be at least partially defined by a step, shoulder, etc., shown as step 128. In some embodiments, step 128 is defined as a change in diameter between groove 125 and inner periphery 126. For example, groove 125 may have a diameter greater than the diameter of inner periphery 126. O-ring 121 can be configured to seat, be adjacent to, interface with, etc., groove 125 and/or step 128. In an exemplary embodiment, O-ring 121 is disposed within groove 125 adjacent an outer periphery of diverter 102 to restrict the flow of fluid between the outer periphery of diverter 102 and the inner periphery of body 100. In this way, fluid (e.g., fire suppressant agent 24) is prevented from flowing between diverter 102 and body 100 and is forced to flow through one or more inner channels, inner passageways, inner volumes, etc., of diverter 102.

Referring still to FIG. 3, diverter portion 118 is shown to include a second shoulder, step, change in diameter, etc., shown as shoulder 148. Shoulder 148 may be configured to provide a surface which diverter 102 is adjacent to. For example, diverter 102 may be configured to threadingly interface with body 100 and be adjacent shoulder 148. Shoulder 148 may be defined by the transition between frustoconical inner volume 114 and diverter portion 118. Shoulder 148 of diverter portion 118 of body 100 may be configured to interface with shoulder 159 of diverter 102 (see FIG. 4). Diverter portion 118 also includes a step, change in diameter, corner, etc., shown as step 128. Step 128 of diverter portion 118 may be configured to interface with shoulder 153 of diverter 102 (see FIG. 4), according to some embodiments.

Figure 9:
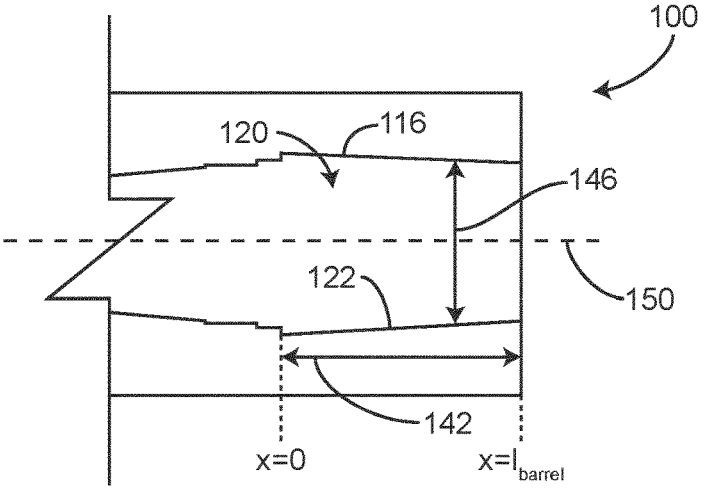
FIG. 9 is a side sectional view of the barrel of the nozzle of FIG. 2 having a linearly decreasing inner diameter, according to an exemplary embodiment.
Figure 10:
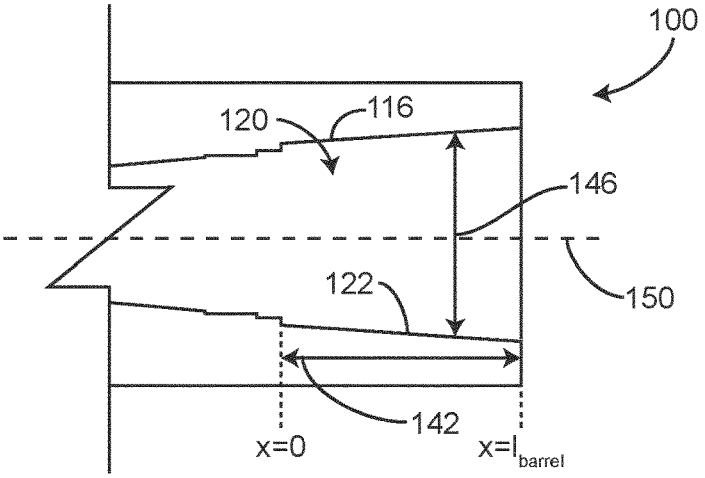
FIG. 10 is a side sectional view of the barrel of the nozzle of FIG. 2 having a linearly increasing inner diameter, according to another exemplary embodiment.
Figure 11:
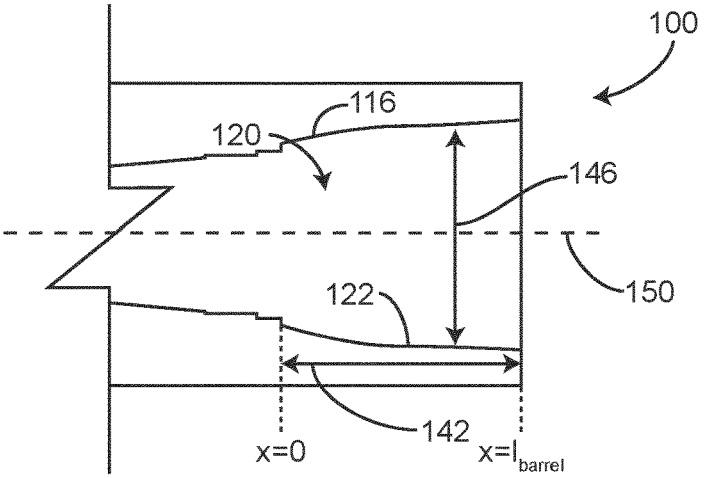
FIG. 11 is a side sectional view of the barrel of the nozzle of FIG. 2 having a non-linearly increasing inner diameter, according to another exemplary embodiment.

Referring still to FIG. 3, body 100 it shown to include barrel 116, according to an exemplary embodiment. Barrel 116 includes an inner surface, an inner sidewall, an inner edge, an inner periphery, etc., shown as inner surface 122. Barrel 116 defines an inner volume 120 therewithin. When diverter 102 is interfaced with body 100, at least a portion of diverter 102 may be within inner volume 120 of barrel 116. Inner surface 122 may be a cylindrical inner surface as shown in FIG. 3. In other embodiments, inner surface 122 is a frustoconical surface. Barrel 116 is shown having a diameter 146. Diameter 146 may be a diameter of inner volume 120 measured between opposite vertices of inner surface 122. Barrel 116 may have an overall longitudinal length 142 (e.g., a depth). In some embodiments, diameter 146 is substantially the same along length 142 as shown in FIG. 3. In other embodiments, diameter 146 decreases linearly along length 142 as shown in FIG. 9. In other embodiments, diameter 146 increases linearly along length 142 as shown in FIG. 10. In other embodiments, diameter 146 increases and/or decreases non-linearly along length 142 as shown in FIG. 11. The overall shape, size, and angle of inner surface 122 may direct the flow of fire suppressant agent 24 as it exits output aperture 105, thereby adjusting the spread, shape and/or range of fire suppressant agent 24. Diameter 146 of inner surface 122/barrel 116 can be referred to as $d_{barrel}$. Length 142 can be referred to as $l_{barrel}$. In some embodiments, $d_{barrel}$ is a function of a position x from x=0 (i.e., a beginning of barrel 116) to $x=l_{barrel}$ (e.g., an end of barrel 116). Diameter 146, $d_{barrel}$, may be defined along length 142 as:

$$d_{barrel}=f_{barrel}(x)|0\leq x\leq l_{barrel}$$

according to some embodiments. FIG. 9 shows $d_{barrel}$ decreasing linearly along length 142, therefore, the above equation can be represented as:

$$d_{barrel}(x)=f_{barrel}(x)=-mx+d_{barrel,x=0}|0\leq x\leq l_{barrel}$$

where m is a rate of change of $d_{barrel}$ with respect to position x along length 142, and $d_{barrel,x=0}$ is an initial value of diameter 146 (e.g., diameter 146 at x=0).

FIG. 10 shows $d_{barrel}$ increasing linearly along length 142 and may be represented as:

$$d_{barrel}(x)=f_{barrel}(x)=mx+d_{barrel,x=0}|0\leq x\leq l_{barrel}$$

according to another embodiment.

FIG. 11 shows $d_{barrel}$ increasing non-linearly along length 142 and may be represented as a second order polynomial:

$$d_{barrel}(x)=f_{barrel}(x)=c_1x^2+c_2x+d_{barrel,x=0}|0\leq x\leq l_{barrel}$$

or a third order polynomial:

$$d_{barrel}(x)=f_{barrel}(x)=c_1x^3+c_2x^2+c_3x+d_{barrel,x=0}|0\leq x\leq l_{barrel}$$

or an mth order polynomial:

$$d_{barrel}(x)=f_{barrel}(x)=c_mx^m+c_{m-1}x^{m-1}+\ \ .\ \ .\ \ .\ \ +d_{barrel,x=0}|0\leq x\leq l_{barrel}$$

according to various embodiments.

In still other embodiments, $f_{barrel}$ is a logarithmic function, an exponential function, a piecewise function, a rational function, etc., or a combination of one or more linear or non-linear functions (e.g., a piecewise function including a first linearly increasing portion and a second non-linearly decreasing function). Diameter 146 may increase along one or more portions of length 142 (e.g., linearly or non-linearly) and/or may decrease along one or more portions of length 142 (e.g., linearly or non-linearly). It should be noted that $f_{barrel}$ is always bounded from x=0 to $x=l_{barrel}$, however, $l_{barrel}$ may change (e.g., increased or decreased), and the initial diameter $d_{barrel,x=0}$ may be greater than or less than as shown in the FIGURES.

Inner surface 122 of barrel 116 may be configured to receive fire suppressant agent 24 exiting diverter holes 152. Diverter 102 may direct fire suppressant agent 24 outwards towards inner surface 122 of barrel 116. The shape, size, length 142, and diameter 146 of inner surface 122/barrel 116 determines the shape and range of fire suppressant agent 24 that exits outlet aperture 105.

Barrel 116 may have a circular cross-sectional shape, an elliptical shape, a square cross-sectional shape, a hexagonal cross sectional shape, etc. The cross-sectional shape of barrel 116 may determine an overall shape of fire suppressant agent 24 after it exits nozzle 14.

Diverter

Figure 4:
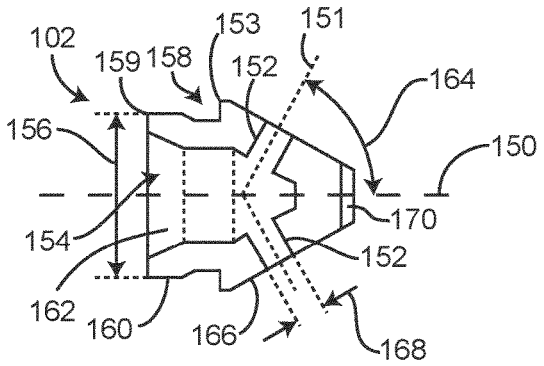
FIG. 4 is a side sectional view of the diverter of the nozzle of FIG. 2, according to an exemplary embodiment.

Referring now to FIG. 4, diverter 102 is shown in greater detail, according to an exemplary embodiment. Diverter 102 includes an inner volume 154 therewithin configured to receive the flow of fire suppressant agent 24 from frustoconical inner volume 114. Diverter 102 may include a chamfered surface 162 at an inlet end of diverter 102. Chamfered surface 162 may be a surface of inner volume 154 at the inlet end of diverter 102. Diverter 102 includes cylindrical outer surface 160 (e.g., an outer face, an outer periphery, an outer edge, etc.). Outer surface 160 may include threads configured to threadingly interface with the threads of inner periphery 126 of body 100 to removably couple diverter 102 to body 100. The threaded interface between outer surface 160 of diverter 102 and inner periphery 126 of body 100 may be a sealed interface such that fluid cannot flow between outer surface 160 of diverter 102 and inner periphery 126 of body 100. Diverter 102 includes a notch, channel, recession, groove, etc., shown as groove 158. Groove 158 is configured to receive O-ring 121 therewithin. When diverter 102 is assembled with body 100, groove 158 of diverter 102 is adjacent groove 125 of body 100 such that O-ring 121 is positioned therewithin. O-ring 121 prevents fluid from flowing along an outer periphery of diverter 102. In this way, fire suppressant agent 24 cannot flow between diverter 102 and body 100 (e.g., there is no fluid flow path formed between the outside of diverter 102 and an inner surface of body 100) and fire suppressant agent 24 must flow through inner volume 154 of diverter 102.

Referring still to FIG. 4, diverter 102 includes one or more apertures, flow passages, passageways, orifices, etc., shown as diverter holes 152. Diverter holes 152 extend radially and angularly outwards from central axis 150. As shown in FIG.

4, diverter holes 152 extend radially outwards from central axis 150 at angle 164. Angle 164 is defined between central axis 150 and a central axis extending normal to and through a center of one of diverter holes 152. Diverter holes 152 fluidly couple inner volume 154 of diverter 102 with inner volume 120 of barrel 116. Diverter holes 152 are configured to guide fire suppressant agent 24 flowing within inner volume 154 of diverter 102 radially outwards at angle 164 such that fire suppressant agent 24 contacts inner surface 122 of barrel 116. Diverter holes 152 extend radially outwards to angled surface 166. Angled surface 166 is an outer surface of diverter 102.

Diverter holes 152 may have a circular cross-sectional shape having diameter 168. In other embodiments, diverter holes 152 have an elliptical cross-sectional shape. In still other embodiments, diverter holes 152 have a hexagonal cross-sectional shape, a square cross-sectional shape, an irregular cross-sectional shape, etc. Diverter holes 152 may each have an area $$A_{diverter,hole} = \pi\left(\frac{d_{diverter,hole}}{2}\right)^2$$

where $d_{diverter,hole}$ is diameter 168. Multiple diverter holes 152 may be patterned about central axis 150. A total cross-sectional area of diverter holes 152 for n diverter holes 152 can be determined using:

$$A_{diverter} = nA_{diverter,hole} = n\pi\left(\frac{d_{diverter,hole}}{2}\right)^2.$$

In an exemplary embodiment, $A_{diverter}$ (the total cross-sectional area of n diverter holes 152) is greater than $A_{orifice}$ such that diverter holes 152 do not restrict the flow of fire suppressant agent 24 (i.e., $A_{orifice}>A_{diverter}$). Rather, diverter holes 152 direct fire suppressant agent 24 as it flows through diverter holes 152. The size (e.g., $d_{diverter,hole}$, $A_{diverter}$, etc.), shape (e.g., circular cross-sectional shape, hexagonal cross-sectional shape, etc.), angle (e.g., angle 164), and number (e.g., n=2, n=4, etc.) of cross-sectional holes 152 can be adjusted to change the shape and range of fire suppressant agent 24 which exits nozzle 14.

Diverter 102 can include a receiving portion 170 at an end. Receiving portion 170 is configured to interface with an installation and/or adjustment tool. For example, receiving portion 170 can be configured to interface with a Philips screwdriver, a flat-heat screwdriver, etc., to transfer torque from the installation/adjustment/removal tool to facilitate installation or removal diverter 102.

Figure 6:
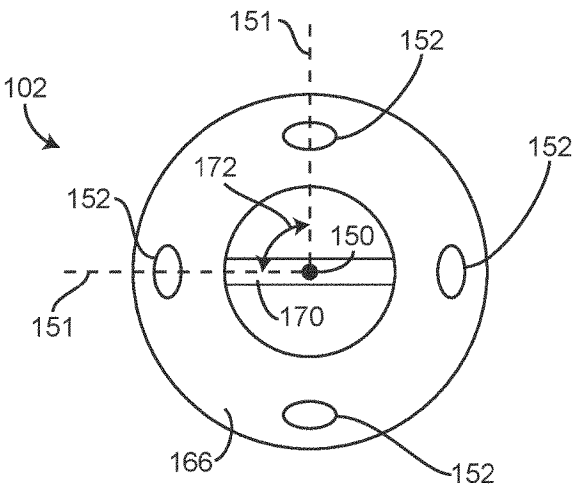
FIG. 6 is a front view of the diverter of the nozzle of FIG. 2 having four diverter holes, according to another exemplary embodiment.
Figure 5:
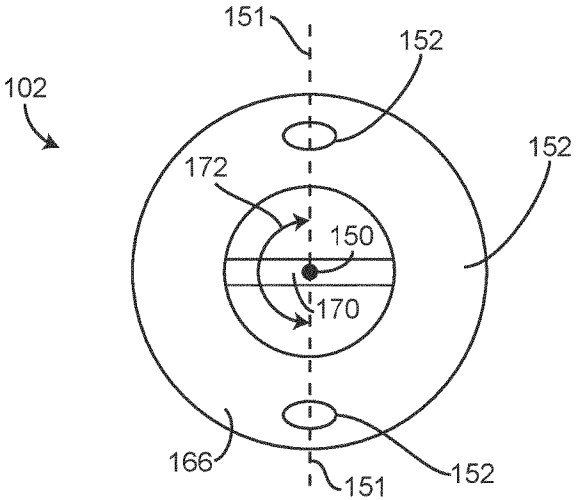
FIG. 5 is a front view of the diverter of the nozzle of FIG. 2 having two diverter holes, according to an exemplary embodiment.
Figure 7:
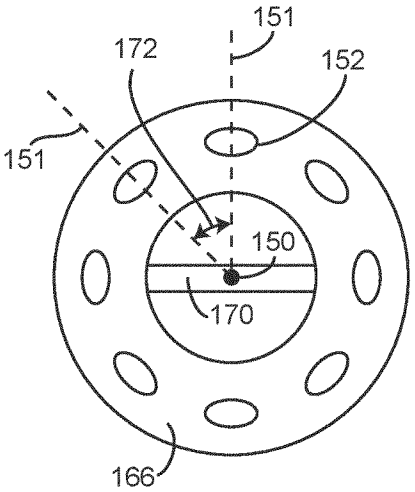
FIG. 7 is a front view of the diverter of the nozzle of FIG. 2 having eight diverter holes, according to another exemplary embodiment.

Referring now to FIGS. 5-8, diverter 102 is shown according to various embodiments. Diverter 102 may include any number of diverter holes 152. FIG. 5 shows diverter 102 having two diverter holes 152. FIG. 5 may correspond to diverter 102 as shown in FIGS. 2 and 4. FIG. 6 shows diverter 102 including four diverter holes 152, each displaced angle 172 from each other. Angle 172 is defined as an angle between centerlines 151 of neighboring diverter holes 152. Centerline 151 extends through a center of a corresponding diverter hole 152. As shown in FIG. 6, angle 172 is 90 degrees. FIG. 7 shows diverter 102 having eight diverter holes 152. Angle 172 for the embodiment shown in FIG. 7 is 45 degrees. Angle 172 may be referred to as θ. If diverter holes 152 are evenly displaced relative to each other about central axis 150, $$\theta = \frac{n}{360}.$$

Figure 8:
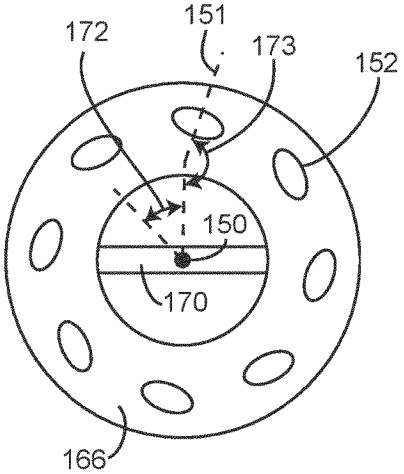
FIG. 8 is a front view of the diverter of the nozzle of FIG. 2 having eight diverter holes helically angled, according to another exemplary embodiment.

Diverter holes 152 may also be helically angled as shown in FIG. 8. For example, each of diverter holes 152 may be angularly offset by angle 172 from each other and helically angled by angle 173. Angle 173 is defined as an angle between an axis that extends radially outwards from axis 150 and centerline 151 of a corresponding diverter hold 152.

Figure 12:
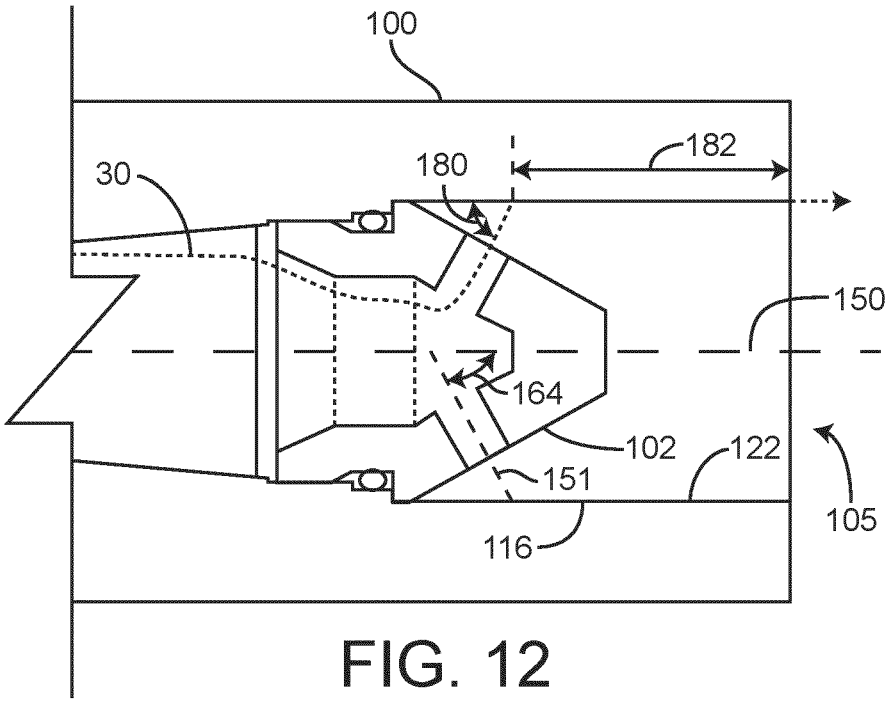
FIG. 12 is a side sectional view of the diverter and the barrel of the nozzle of FIG. 2, with the diverter holes at a first angle, according to an exemplary embodiment.
Figure 13:
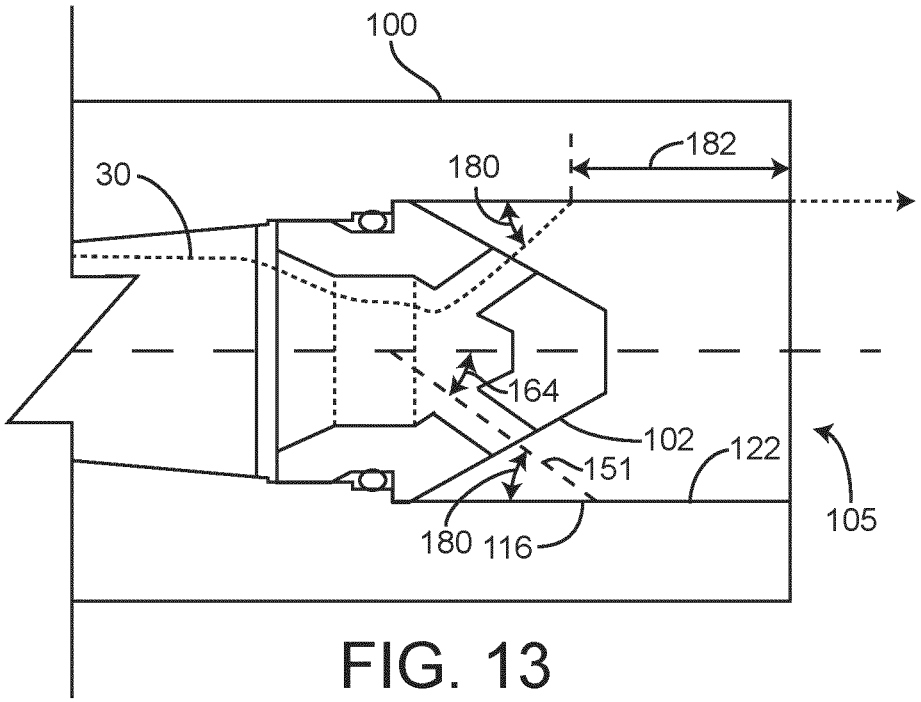
FIG. 13 is a side sectional view of the diverter and the barrel of the nozzle of FIG. 2, with the diverter holes at a second angle, according to another exemplary embodiment.

Referring now to FIGS. 12 and 13, cross-sectional views of various embodiments of diverter 102 assembled with body 100 are shown. FIG. 12 shows diverter 102 having diverter holes 152 at angle 164 (i.e., $\theta_1$) and FIG. 13 shows diverter 102 having diverter holes 152 at angle 164 (i.e., $\theta_2$), with $\theta_2<\theta_1$. Adjusting angle 164 facilitates adjustment of angle 180. Angle 180 is the angle at which fire suppressant agent 24 flowing along fluid flow path 30 contacts inner surface 122 after passing through diverter 102. As shown in FIGS. 12-13, decreasing angle 164 results in decreasing angle 180. Additionally, adjusting angle 164 affects a distance 182 at which fire suppressant agent 24 contacts inner surface 122 with respect to outlet aperture 105. Decreasing angle 164 decreases distance 182 as shown in FIGS. 12-13. Angle 164 can be adjusted to adjust a discharge length 404 (see FIG. 14) of fire suppressant agent 24 exiting outlet aperture 105.

Controllability

Referring now to FIG. 14, diagram 400 illustrates discharge length 404, according to an exemplary embodiment. Discharge length 404 may be referred to as l. Discharge length 404 is the length which fire suppressant agent 24 travels along fluid flow path 30 after exiting nozzle 14. Diagram 400 shows fire suppressant agent 24 exiting nozzle 14 along a variety of fluid flow paths 30*a-c* to provide fire suppression to area 406. Nozzle 14 is shown a height 402 above ground surface 408. As fire suppressant agent 24 exits nozzle 14, gravity causes fire suppressant agent 24 to fall to ground surface 408. Discharge length 404 may be related to the velocity $v_{FSA}$ or the volumetric flow rate $\dot{V}_{FSA}$ of fire suppressant agent 24, as well as wind resistance, and acceleration due to gravity. Additionally, discharge length 404 may be related to the geometry, shape, size, etc., of orifice 112 and/or the geometry, shape, size, etc., of barrel 116. Angle 164 can also be adjusted to affect discharge length 404. For example, decreasing angle 164 may increase the velocity at which fire suppressant agent 24 exits nozzle 14, thereby increasing discharge length 404.

Fluid flow path 30*a* is shown having discharge length 404*a* (i.e., $l_a$). Fluid flow path 30*b* is shown having discharge length 404*b* (i.e., $l_b$). Fluid flow path 30*c* is shown having discharge length 404*c* (i.e., $l_c$). Each fluid flow path 30 and corresponding discharge length 404 can represent various values of angle 164 of diverter holes 152. For example, discharge length 404*a* corresponds to a value $\theta_a$ of angle 164, discharge length corresponds to value $\theta_b$ of angle 164, and discharge length 404*c* corresponds to a value $\theta_c$ of angle 164. Adjusting angle 164 can result in an increase or a decrease of discharge length 404. Advantageously, since $A_{diverter}$ is less than $A_{orifice}$, discharge length 404 can be adjusted by adjusting the value of angle 164 without changing the volumetric flow rate $\dot{V}_{FSA}$ (and therefore the discharge time $\Delta t_{discharge}$) of fire suppressant agent 24. Additionally, discharge length 404 can be adjusted (e.g., increased or decreased) to a desired value by changing the geometry of barrel 116. For example, any of the cross-sectional shape, length 142, diameter 146, and/or variation of diameter 146 along length 142 (i.e., $f_{barrel}$) can be changed to independently (or in combination with changes in angle 164) affect discharge length 404 to achieve a desired discharge length 404.

Referring now to FIG. 15, diagram 500 illustrates discharge diameter 504 of fire suppressant agent 24 at a distance 502 from nozzle 14, according to an exemplary embodiment. Discharge diameter 504 is the diameter which fire suppressant agent 24 is spread across after travelling distance 502 from nozzle 14. In some embodiments, discharge diameter 504 is a maximum diameter which fire suppressant agent 24 reaches after exiting nozzle 14. Discharge diameter 504 may indicate an area over which fire suppressant agent 24 spreads after exiting nozzle 14. Discharge diameter 504 can be a diameter of a pattern of fire suppressant agent 24 such as a circular pattern (e.g., a circular spread of fire suppressant agent 24), an elliptical pattern (e.g., an elliptical spread of fire suppressant agent 24), or an average diameter of fire suppressant agent 24 at distance 502.

Discharge diameter 504 and/or the shape of the pattern (e.g., spread) of fire suppressant agent 24 can be controlled by adjusting the geometry of barrel 116. For example, any of the cross-sectional shape, length 142, diameter 146, and/or variation of diameter 146 along length 142 (i.e., $f_{barrel}$) can be changed to independently (or in combination with changes to diverter 102) affect discharge diameter 504 and/or the shape of the pattern of fire suppressant agent 24 to achieve a desired discharge diameter 504 and/or a desired spray pattern of fire suppressant agent 24. The number, size, angulation, and/or cross-sectional shape of diverter holes 152 can also be adjusted (either independently or in combination with changes to barrel 116) to achieve a desired discharge diameter 504 and/or a desired spray shape of fire suppressant agent 24.

Since orifice 112 is the most restrictive portion of nozzle 14, diameter 124 (i.e., $d_{orifice}$) and/or the cross-sectional area (i.e., $A_{orifice}$) can be adjusted to achieve a desired discharge time $\Delta t_{discharge}$. For example, the discharge coefficient $C_d$ of orifice 112 can be adjusted by changing the geometry (e.g., size and shape) of orifice 112 to achieve a desired volumetric flow rate $\dot{V}_{FSA}$ and/or a desired discharge time $\Delta t_{discharge}$ of fire suppressant agent 24. In some embodiments, increasing diameter 124 of orifice 112 increases the volumetric flow rate $\dot{V}_{FSA}$ of fire suppressant agent 24, decreases the discharge time $\Delta t_{discharge}$, increases discharge length 404, and increases discharge diameter 504. If increasing diameter 124 of orifice 112 to achieve a desired discharge time $\Delta t_{discharge}$ results in an undesired discharge length 404 and/or an undesired discharge diameter 504, the geometry of diverter holes 152 of diverter 102 (e.g., the diameter, the cross-sectional area, the number, angle 164, etc.) and/or the geometry of barrel 116 (e.g., the cross-sectional shape, length 142, diameter 146, and/or variation of diameter 146 along length 142 (i.e., $f_{barrel}$)) can be adjusted to achieve the desired discharge length 404 and/or the desired discharge diameter 504 without affecting the desired discharge time $\Delta t_{discharge}$.

Advantageously, nozzle 14 can be adjusted to facilitate controllability of any of the discharge time $\Delta t_{discharge}$, discharge length l (i.e., discharge length 404), discharge diameter 504, and/or the spray pattern of fire suppressant agent 24. The discharge time $\Delta t_{discharge}$, discharge length l (i.e., discharge length 404), discharge diameter 504 (i.e., the spread), and the spray pattern of fire suppressant agent 24 can be referred to as the "controlled parameters." Advantageously, nozzle 14 provides three points of controllability to either independently change one or more of the corresponding controlled parameters or to adjust one or more of the controlled parameters. The three points of controllability of nozzle 14 are orifice 112, diverter 102, and barrel 116. Orifice 112 can be adjusted (e.g., independently) to achieve a desired discharge time $\Delta t_{discharge}$, as described in greater detail hereinabove. Diverter 102 and/or barrel 116 can be adjusted (either independently or in combination) to achieve a desired discharge length 404 (i.e., l), a desired discharge diameter 504, and/or a desired spray pattern of fire suppressant agent 24. Advantageously, nozzle 14 can be adjusted to achieve any desired combination of discharge time $\Delta t_{discharge}$, discharge length 404, discharge diameter 504, and the spray pattern of fire suppressant agent 24. Other fire suppression apparatuses only provide two points of controllability such that certain combinations of discharge time $\Delta t_{discharge}$, discharge length 404 and discharge diameter 504 are not possible. Advantageously, nozzle 14 can be adjusted to achieve various combinations of discharge time $\Delta t_{discharge}$, discharge length 404 and discharge diameter 504 which are not possible with other fire suppression apparatuses.

Configuration of Exemplary Embodiments

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, and/or illustrations of possible embodiments (and such terms are not intended to connote that such embodiments are necessarily extraordinary or superlative examples).

The term "coupled," as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. Such members may be coupled mechanically, electrically, and/or fluidly.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the fire suppression system and the nozzle as shown in the various exemplary embodiments is illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. Other substitutions, modifications, changes, and omissions may be made in the design, operating conditions and arrangement of the exemplary embodiments without departing from the scope of the present disclosure.

Additionally, any element disclosed in one embodiment may be incorporated or utilized with any other embodiment disclosed herein. For example, the linearly decreasing inner diameter 146 of the barrel 116 of the exemplary embodiment described with reference to FIG. 9 may be incorporated in the nozzle 14 of the exemplary embodiment described with reference to FIG. 2. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A fire suppression apparatus configured to spray a fire suppressant agent, the apparatus comprising:

a reservoir configured to store the fire suppressant agent;

a nozzle fluidly coupled to the reservoir, the nozzle comprising:

a body member defining:

an inlet aperture;

an outlet aperture; and a passageway extending between the inlet aperture and the outlet aperture; and a diverter separate from the body member and positioned entirely within the passageway of the body member downstream of the inlet aperture and upstream of the outlet aperture, the diverter comprising a plurality of diverter passageways configured to receive the fire suppressant agent from an inner volume of the diverter and direct the fire suppressant agent towards an inner sidewall of the passageway.

2. The fire suppression apparatus of claim 1, wherein an inner diameter of the inner sidewall varies along a longitudinal length of the passageway.

3. The fire suppression apparatus of claim 2, wherein the inner diameter of the inner sidewall increases linearly or non-linearly along the longitudinal length of the passageway.

4. The fire suppression apparatus of claim 2, wherein the inner diameter of the inner sidewall decreases linearly or non-linearly along the longitudinal length of the passageway.

5. The fire suppression apparatus of claim 1, further comprising a rate controlling orifice positioned along the passageway, wherein the rate controlling orifice is a most restrictive portion of the nozzle along the passageway and is sized to determine an amount of time required to fully discharge the fire suppressant agent from the reservoir.

6. The fire suppression apparatus of claim 1, wherein the plurality of diverter passageways are angled and the diverter is configured to affect a distance that the fire suppressant agent is discharged after the fire suppressant agent exits the nozzle and a spread of the fire suppressant agent after the fire suppressant agent exits the nozzle.

7. The fire suppression apparatus of claim 6, wherein an interior shape of the inner sidewall is configured to affect at least one of the spread of the fire suppressant agent after the fire suppressant agent exits the nozzle or the distance of the fire suppressant agent after the fire suppressant agent exits the nozzle.

8. The fire suppression apparatus of claim 1, wherein the fire suppressant agent is any of a dry fire suppressant agent, a wet fire suppressant agent, and a clean fire suppressant agent.

9. The fire suppression apparatus of claim 1, wherein the apparatus is any of a handheld fire suppression apparatus, a wheel fire suppression apparatus, or a fire suppression apparatus system for an area.

10. The fire suppression apparatus of claim 1, wherein the diverter comprises a frustoconical portion and a generally cylindrical portion, wherein the frustoconical portion is at a downstream end of the diverter, and the generally cylindrical portion it at an upstream end of the diverter.

11. The fire suppression apparatus of claim 1, wherein the diverter comprises a converging inlet that fluidly couples with the plurality of diverter passageways.

12. The fire suppression apparatus of claim 1, wherein the diverter is threadingly coupled into the body member.

13. The fire suppression apparatus of claim 12, wherein the diverter comprises a receiving portion at an end of the diverter, the receiving portion configured to receive a tool to install or remove the diverter from the body member, the body member configured to receive the tool through the outlet aperture.

14. The fire suppression apparatus of claim 13, wherein the tool is a screwdriver and the receiving portion is configured to receive and interface with an end of the screwdriver.

15. A fire suppression apparatus comprising:

a container configured to store a fire suppressant agent; and a nozzle fluidly coupled with the container, the nozzle configured to receive the fire suppressant agent from the container and discharge the fire suppressant agent, the nozzle comprising:

a passageway fluidly coupled with the container;

a rate controlling orifice positioned along the passageway;

a diverter positioned within the passageway downstream from the rate controlling orifice, the diverter comprising an inner volume and a plurality of angled passageways the angled passageways extending at least partially in a direction towards a longitudinal end of the passageway, the inner volume fluidly coupled with the passageway of the nozzle and fluidly coupled with the plurality of angled passageways; and a barrel configured to receive fire suppressant agent that exits the plurality of angled passageways and direct the fire suppressant agent through an outlet of the nozzle.

16. The fire suppression apparatus of claim 15, wherein an angle of the plurality of angled passageways are angled so that the fire suppressant agent that flows through the diverter is directed outwards towards an interior surface of the barrel to achieve a specific discharge distance or spread of the fire suppressant agent after the fire suppressant agent exits the nozzle through the outlet.

17. The fire suppression apparatus of claim 15, wherein a volumetric flow rate permitted by the rate controlling orifice is greater than or equal to a volumetric flow rate permitted by the diverter.

18. The fire suppression apparatus of claim 15, wherein the diverter is threadingly coupled in the passageway.

19. The fire suppression apparatus of claim 18, wherein the diverter comprises a receiving portion at an end of the diverter, the receiving portion configured to receive a tool to install or remove the diverter from the body member, the body member configured to receive the tool through the outlet aperture.

20. A fire suppression apparatus configured to spray a fire suppressant agent, the apparatus comprising:

a reservoir configured to store a fire suppressant agent;

a nozzle fluidly coupled to the reservoir, the nozzle comprising:

an inlet aperture;

an outlet aperture;

a passageway extending between the inlet aperture and the outlet aperture; and a diverter disposed within the passageway and comprising a plurality of diverter passageways configured to receive the fire suppressant agent from an inner volume of the diverter and direct the fire suppressant agent towards an inner sidewall of the passageway , wherein the diverter comprises a frustoconical portion and a generally cylindrical portion, wherein the frustoconical portion is at a downstream end of the diverter, and the generally cylindrical portion it at an upstream end of the diverter.

* * * * *